US005423303A

United States Patent [19]

Bennett

[11] Patent Number: 5,423,303

[45] Date of Patent: Jun. 13, 1995

[54] FUEL RAIL FOR INTERNAL COMBUSTION ENGINE

[76] Inventor: David E. Bennett, 14687 Country Road 8 SE., Lake Lillian, Minn. 56253

[21] Appl. No.: 69,558

[22] Filed: May 28, 1993

[51] Int. Cl.[6] ..... F02B 43/00

[52] U.S. Cl. ..... 123/527; 123/456; 123/541

[58] Field of Search ..... 123/41.31, 527, 456, 123/516, 541

[56] References Cited

U.S. PATENT DOCUMENTS

| | | | |
|---|---|---|---|
| 4,099,496 | 7/1978 | Nagase | 123/41.31 |
| 4,489,700 | 12/1984 | van der Weide | 123/527 |
| 4,503,831 | 3/1985 | Rijkeboer | 123/527 |
| 4,503,832 | 3/1985 | Pefley | 123/541 |
| 4,570,602 | 2/1986 | Atkins | 123/456 |
| 4,768,492 | 9/1988 | Widmer | 123/41.31 |
| 5,044,539 | 9/1991 | Hafner | 123/41.31 |
| 5,076,242 | 12/1991 | Parker | 123/516 |
| 5,076,244 | 12/1991 | Donaldson | 123/527 |
| 5,156,134 | 10/1992 | Tochizawa | 123/468 |
| 5,197,436 | 3/1993 | Ozawa | 123/456 |

FOREIGN PATENT DOCUMENTS

| | | |
|---|---|---|
| WO81/00282 | 2/1981 | WIPO . |
| WO92/08886 | 5/1992 | WIPO . |
| WO92/08888 | 5/1992 | WIPO . |

*Primary Examiner*—Carl S. Miller

*Attorney, Agent, or Firm*—Merchant, Gould, Smith, Edell, Welter & Schmidt

[57] ABSTRACT

A fuel rail for supplying liquified petroleum gas ("LPG") to an internal combustion engine. Fuel supply channel and fuel return channel are aligned generally parallel to one another within fuel rail. LPG flowing through return channel cools LPG flowing through supply channel by vaporization of return fuel. Vaporization is caused by lower pressure in return channel relative to supply channel. Cooling of supply fuel aids in maintaining LPG injected into the engine in a fully liquid state. This results in increased power output, lower toxic emissions, and a reduction in knocking.

9 Claims, 4 Drawing Sheets

FUEL RAIL FOR INTERNAL COMBUSTION ENGINE

Applicant's applications, appl. Ser. No. 69,199, now issued as U.S. Pat. No. 5,291,869; appl. Ser. No. 68,769, now issued as U.S. Pat. No. 5,325,838; and "Fuel Pressure Regulator and Method for Purging", all filed on even date herewith and commonly owned are incorporated by reference.

FIELD OF THE INVENTION

This invention relates generally to fuel rails for supplying fuel to an internal combustion engine. More particularly, this invention relates to a fuel rail for supplying liquified petroleum gas to an internal combustion engine.

BACKGROUND OF THE INVENTION

Fuel rails for supplying gasoline fuel to an internal combustion engine are well known in the art. These fuel rails generally provide a manifold from which fuel is distributed to a plurality of individual fuel injectors (i.e. "multi-point" fuel injection).

In the most common arrangement, fuel is pumped from a fuel reservoir, through a fuel supply line, to the fuel rail. In some designs, a fuel pressure damper is employed at a point upstream of the fuel rail. Fuel flows through the fuel rail to a plurality of fuel injectors. The fuel rail is attached to the top of the fuel injectors, and supplies fuel into the upper end of each fuel injector, which then injects the fuel into the intake manifold of the engine. Normally, not all of the fuel passing through the rail is fed to the injectors. The remaining fuel passes through the fuel rail to a fuel return line. Typically, a fuel pressure regulator is employed in the fuel return line downstream of the last injector. Fuel exhausted from the injectors is then returned to the reservoir via the return line.

International PCT Publication WO 92/08886 discloses another arrangement whereby two separate fuel rails are employed, one as a fuel inlet rail and the second as a fuel outlet rail. The fuel inlet rail branches to supply each fuel injector with fuel at a "bottom feed" location. The inlet rail is not directly in fluid communication with the fuel return line, as in the above-described arrangement. Instead, all of the fuel in the inlet rail is supplied to the injectors and uninjected fuel is passed through each injector, out its upper end, and to the fuel outlet rail. Fuel then passes from the outlet rail, through a regulator, and back to the reservoir via a fuel return line.

Prior art fuel rails are predominantly designed for use with gasoline or diesel fuels. However, little has been done in the art with respect to fuel rails for supplying liquid petroleum gas ("LPG") to an internal combustion engine.

Interest in alternative fuels, such as LPG, has increased in recent years due to the inherent cost and environmental advantages over other fuels. LPG has particularly received much attention as an alternative to gasoline or diesel for use in internal combustion engines. Propane, the primary constituent of LPG, is a byproduct of the refining of gasoline, and it is a byproduct of the transfer of natural gases in pipelines. It is readily available and at costs far below that of gasoline.

LPG was recently listed under the Clean Air Act in the United States as a suggested alternative fuel because it is more environmentally compatible than gasoline. LPG burns more completely, producing less carbon monoxide and hydrocarbon emissions. Also, using LPG as a fuel reduces the emission of volatile organic compounds which occurs during gasoline refueling.

The United States Federal Government recently promulgated legislation, referred to as Corporate Average Fuel Efficiency ("CAFE") standards, to promote the use of more environmentally compatible fuels. CAFE created a system of incentives which encourages manufacturers to build automobiles and trucks which use alternative fuels such as LPG. As a result, there is increased interest in manufacturing and retrofitting automobiles and trucks to be fueled with LPG.

The injection of liquid fuels such as gasoline into internal combustion engines is well known (see U.S. Pat. No. 4,700,891). Such fuel injectors create fine atomization of liquid fuel, which improves the efficiency of the burning cycle.

Although LPG in its gaseous form has been used as a reasonably effective fuel in internal combustion engines, there is an associated reduction in power capability as compared to liquid LPG fuels. This power reduction is mainly due to the reduced amount of air and fuel which can be drawn into the intake manifold when the LPG enters the manifold in gaseous form.

With liquid LPG, a further gain in power (and simultaneous reduction in the emission of nitrous oxides) results from the cooling of air and fuel within the manifold from vaporization of injected LPG. This also reduces the tendency for engine knock.

Use of LPG in liquid form as a fuel is fairly new in the art. However, several obstacles are associated with attempting to inject liquid LPG directly into the intake manifold of an internal combustion engine. In particular, it is difficult to maintain LPG in its liquid state near the heated engine compartment. LPG has a very low boiling point (See FIG. 6 for the liquid-vapor phase boundaries for propane and isobutane, the primary constituents of LPG). Even under pressure, LPG will tend to bubble or boil as the boiling temperature at a given pressure is approached. The formation of bubbles, often called "champagning" or "flashing," can cause inconsistent injection and poor air/fuel ratio control.

It is thus very desirable to cool supply LPG to prevent the bubbling or boiling which can occur when attempting to inject a low boiling point fuel in a fully liquid state. Although other approaches to cooling LPG have been attempted (see, e.g., U.S. Pat. No. 4,489,700 and U.S. Pat. No. 5,076,244), none have addressed the cooling problem in the design of the fuel rail itself.

Another significant problem encountered with using LPG as a fuel is the contaminants which are contained therein. These contaminants collect in fuel lines, injectors and regulators and can hinder performance. Thus, it would be beneficial if the fuel rail was designed to aid in the removal of these contaminants.

Consequently, it is clear that a simple and effective fuel rail which aids in cooling LPG to maintain it in a liquid state and which promotes the removal of fuel contaminants has been needed.

SUMMARY OF THE INVENTION

According to the present invention, a fuel rail for supplying LPG to an internal combustion engine is provided.

The fuel rail of the present invention includes a fuel supply channel and a fuel return channel. The fuel supply channel is in fluid communication with a fuel supply line, and the fuel return channel is in fluid communication with a fuel return line. The fuel supply and return channels are aligned generally parallel to one another within the fuel rail.

LPG flowing through the supply channel is cooled by the LPG flowing through the return channel. Cooling is accomplished through vaporization of return fuel as it flows through the return channel. Lower pressure in the return channel relative to the supply channel causes return fuel to undergo a phase change to a gaseous state when the boiling point of the LPG is exceeded. This phase change causes heat to be absorbed from the fuel rail and consequently from the fuel in the supply channel, thus cooling the supply fuel.

Cooling of the supply LPG along the fuel rail aids in maintaining LPG injected into the intake manifold in a fully liquid state. This allows more fuel and air to enter the intake manifold prior to the closing of the intake valve, and the vaporization of LPG in the intake manifold cools the fuel and air. The result is improved power output, lower toxic emissions, and a reduction in engine knock.

The invention will be better understood and further advantages thereof will become more apparent from the ensuing detailed description of the preferred embodiment taken in conjunction with the drawings and the claims annexed hereto.

DETAILED DESCRIPTION OF THE PREFERRED EMBODIMENT

Figure 1:
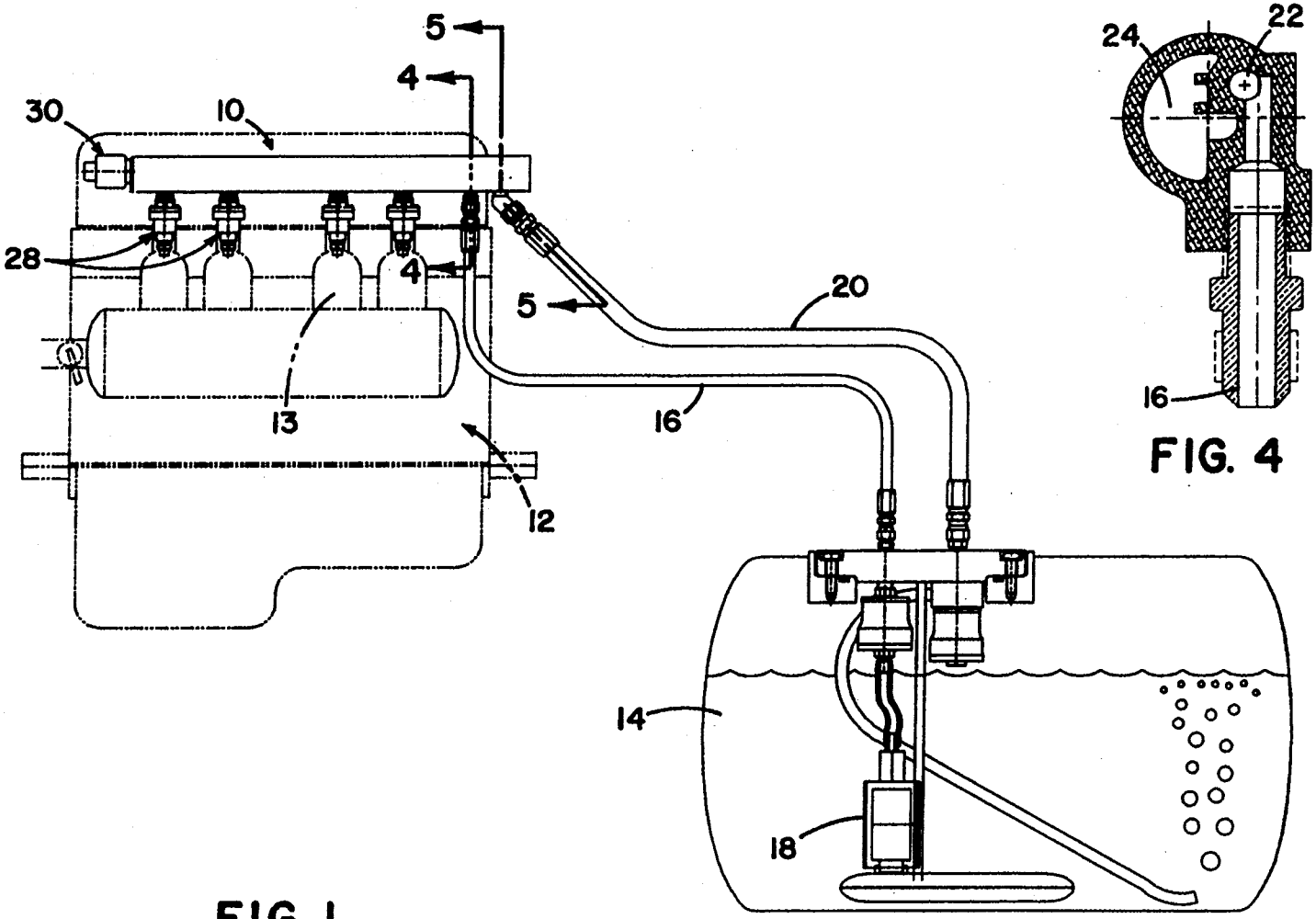
FIG. 1 is a schematic diagram of a fuel supply system with a fuel rail according to the present invention.

Referring now to the drawings, wherein like numerals designate like parts throughout the various figures, and referring in particular to FIG. 1, a fuel rail 10 for supplying liquified petroleum gas ("LPG") fuel to an internal combustion engine 12 is shown. Fuel is provided to fuel rail 10 from fuel reservoir 14. Supply fuel flows from fuel reservoir 14, through fuel supply line 16, to fuel rail 10, under pressure from fuel pump 18. Return fuel flows from fuel rail 10, through fuel return line 20, and back to fuel reservoir 14.

Figure 5:
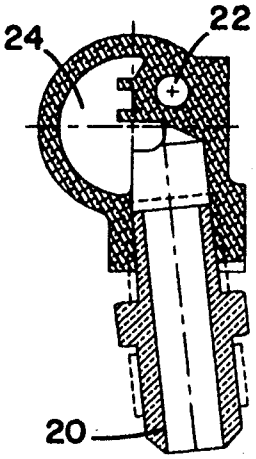
FIG. 5 is a cross-sectional side view of the fuel rail in FIG. 1, showing a return fuel connection according to the present invention, taken along the line 5—5 in FIG. 1.
Figure 4:
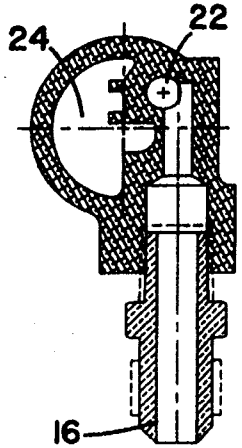
FIG. 4 is a cross-sectional side view of the fuel rail in FIG. 1, showing a supply fuel connection according to the present invention, taken along the line 4—4 in FIG. 1.

Fuel supply line 16 and fuel return line 20 are in fluid communication with fuel supply channel 22 and fuel return channel 24, respectively. In the preferred embodiment, fuel supply line 16 is connected to fuel supply channel 22 at the upstream terminus of supply channel 22, and fuel return line 20 is connected to the downstream terminus of return channel 24, as shown in FIGS. 4 and 5. Commercially available fluid connectors are employed.

Figure 2:
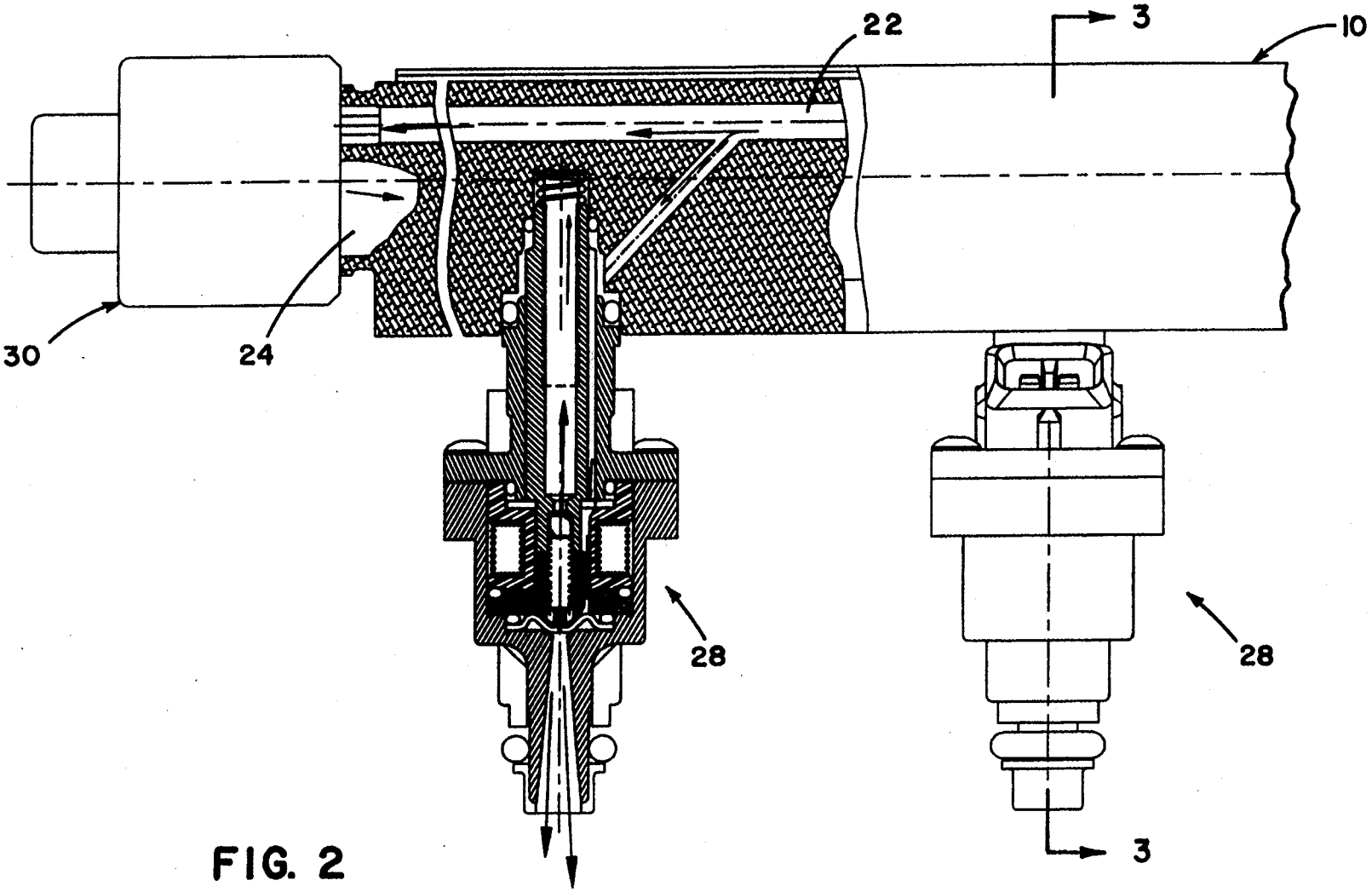
FIG. 2 is a partial cross-sectional front view of a portion of the fuel rail in FIG. 1, with fuel injectors and a pressure regulator connected thereto.
Figure 3:
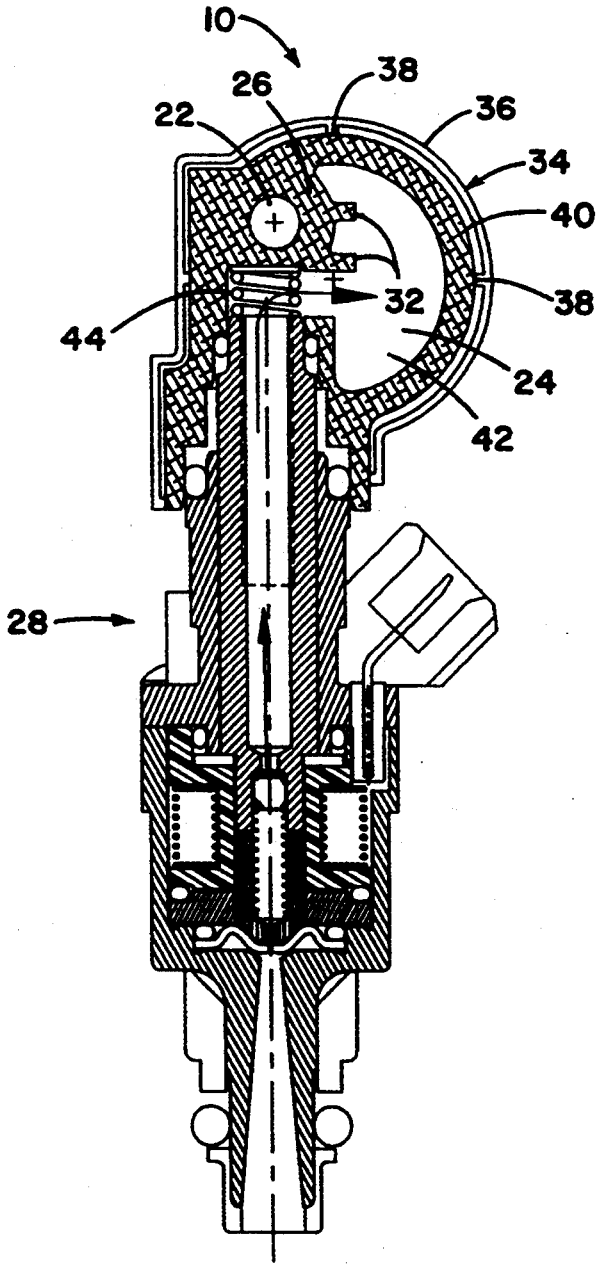
FIG. 3 is a cross-sectional side view of the fuel rail in FIG. 1, with an injector connected thereto, taken along the line 3—3 of FIG. 2.
Figure 6:
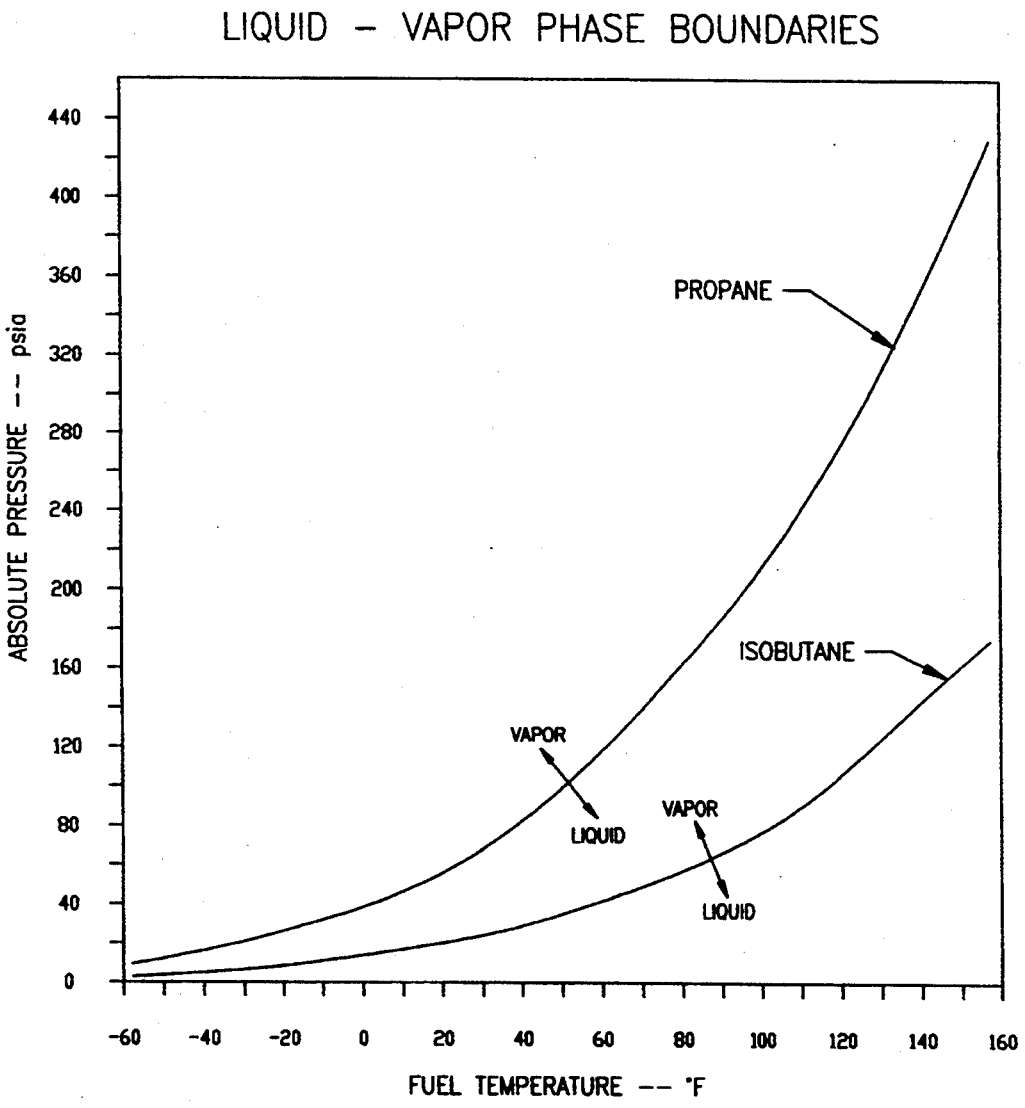
FIG. 6 depicts the liquid-vapor phase boundaries for propane and isobutane.

Referring now to FIGS. 2 and 3, fuel supply 22 and return 24 channels are aligned substantially parallel to one another. The cross-sectional area of return channel 24 is at least four times larger and preferably about 6 to 10 times larger than the cross-sectional area of supply channel 22. Although the cross-sectional shape of fuel rail 10 as depicted in FIG. 3 is asymmetrical to allow close fitting of other engine components, a symmetrical or other shaped design could also be employed.

In the preferred embodiment, fuel rail 10 is manufactured as an aluminum extrusion. Fuel supply 22 and fuel return 24 channels are passages formed therein. It should be recognized, however, that fuel supply 22 and return 24 channels can be formed in a variety of other ways within fuel rail 10. For instance, in order to achieve the desired heat transfer between fuel supply 22 and return 24 channel, there need only be a common wall 26 therebetween, through which heat can be transferred.

Fuel injectors 28 are in fluid communication with both fuel supply 22 and return 24 channels in the preferred embodiment. However, fuel injectors 28 need not be in fluid communication with return channel 24 in order to achieve the desired cooling effect within fuel rail 10. For instance, all fuel supplied to injectors 28 from fuel supply channel 22 can be injected into intake manifold 13 of engine 12, or excess uninjected fuel can be returned to fuel reservoir 14 by way of fuel return lines or otherwise. In the injector 28 of the preferred embodiment, supply fuel is in fluid communication with return fuel via a restriction which maintains a positive pressure differential between supply fuel and return fuel.

Fuel supply 22 and fuel return 24 channels are in fluid communication with each other at the downstream terminus of fuel supply channel 22 via a fuel pressure regulator 30, as shown in FIG. 2. Decreased pressure in fuel return channel 24 relative to fuel supply channel 22 brings the LPG in return channel 24 closer to its vapor pressure and thus its boiling temperature. This decreased pressure, as well as engine compartment heat, cause LPG flowing through fuel return channel 24 to undergo a phase change from a liquid state to a gaseous state. The phase change requires heat, which therefore is absorbed from the core material around fuel supply channel 22, thus cooling the fuel flowing through fuel supply channel 22. Thus, the proximity of fuel supply 22 and fuel return 24 channels allows fuel passing through return channel 24 to draw heat through common wall 26 and to cool the fuel flowing through fuel supply channel 22.

To aid in this heat transfer between supply 22 and return 24 channels, a plurality of protrusions 32 ("fins") are employed along fuel rail 10. Fins 32 extend from common wall 26 into fuel return channel 24. This allows fins 32, due to their larger surface area, to cause more efficient heat transfer between fuel supply 22 and return 24 channels.

Heat shield 34 is employed in the preferred embodiment to insulate fuel rail 10 from engine compartment heat. Heat shield 34 comprises a plastic shell 36 and an air gap 40. Shell 36 is made of a thin (0.03–0.04 inches) thermoplastic material. Plastic shell 36 touches the outer metal surface of fuel rail 10 only at a plurality of contact points 38. The air gap 40 created between shell 36 and fuel rail 10 aids in insulating fuel rail 10 from outside heat.

Preferably, fuel rail 10 is installed at a slight angle with regulator 30 at the high end. This causes contaminants which accumulate along fuel rail 10 to drain from fuel return channel 24 out through fuel return line 20. The most common such contaminant is compressor oil which precipitates when LPG is vaporized. Also, lower portion 42 of fuel return channel 24 is below exhaust opening 44 from fuel injector 28 to return channel 24 to prevent contaminants from draining back into injector 28.

In part, it is the function of regulator 30 to maintain the pressure differential between supply 22 and return 24 channels required to produce the refrigeration cycle in fuel rail 10. In the preferred embodiment, regulator 30 maintains a fuel pressure differential of approximately 50 to 60 psi. Conventional hydromechanical bypass pressure regulators are suitable for this purpose. The regulating device need not be integrated into fuel rail 10, as in the preferred embodiment. Also, regulator 30 need not be referenced to intake manifold 13 pressure, as is commonly done with conventional gasoline regulators.

This design allows for maximum cooling of injected LPG when it is most needed. At full throttle, supply fuel is flowing through fuel injectors 28 into intake manifold 13 at its maximum rate. Under this condition, cooling is not a great concern due to the short residence time of LPG in the engine compartment for absorption of heat. At idle, however, more cooling of supply fuel is required, due to the longer residence time of LPG in fuel supply channel 22. Because the amount of fuel injected at the idle condition is very small, regulator 30 bypasses the maximum amount of fuel to fuel return channel 24. Thus, fuel is flowing through return channel 24 at its maximum rate during the idle condition. This results in maximum cooling of the LPG flowing through supply channel 22 prior to reaching fuel injectors 28.

It should be understood that the present invention is not limited to the preferred embodiment discussed above, which is illustrative only. Changes may be made in detail, especially in matters of shape, size, arrangement of parts, and material of components within the principles of the invention, to the full extent indicated by the broad general meanings of the terms in which the appended claims are expressed.

What is claimed is:

1. A fuel rail for supplying liquified petroleum gas to a plurality of fuel injectors which inject fuel into the intake manifold of an internal combustion engine having a fuel reservoir, comprising:

a fuel supply channel for supplying fuel to the fuel injectors and a fuel return channel for returning fuel to the fuel reservoir;

said channels being arranged in a generally parallel fashion and being constructed and arranged so as to permit heat transfer between one another;

said channels extending along each of the fuel injectors, with said fuel supply channel being separately in fluid communication with each of the plurality of fuel injectors through a like plurality of flow passages extending from said fuel supply channel to each of the fuel injectors; and means for cooling fuel flowing through said fuel supply channel so as to maintain fuel injected into the intake manifold in a substantially liquid state, said cooling means including means for vaporizing liquified petroleum gas as it flows through said return channel.

2. A fuel rail for supplying liquified petroleum gas to a plurality of fuel injectors which inject fuel into an internal combustion engine, comprising:

fuel supply and return channels aligned generally parallel to one another and extending along each of the fuel injectors, said fuel rail including means for separately providing fluid communication between said fuel supply channel and each of the fuel injectors; and means for cooling fuel flowing through said fuel supply channel, said cooling means including means for vaporizing liquified petroleum gas as it flows through said return channel.

3. The fuel rail of claim 1, said fuel supply and return channels being formed within a metal extrusion, wherein said means for cooling fuel flowing through said fuel supply channel further include a plurality of protrusions extending away from said fuel supply channel and into said fuel return channel.

4. The fuel rail of claim 2 wherein each of the fuel injectors is in fluid communication with said fuel return channel via a fuel injector exhaust opening.

5. The fuel rail of claim 1 wherein the fuel rail further comprises a heat shield for insulating structure including the fuel supply and return channels from engine compartment heat, said heat shield comprising an outer shell substantially surrounding the fuel rail and an air gap between said outer shell and the fuel rail.

6. The fuel rail of claim 4, wherein at least a portion of said fuel return channel is below said exhaust opening thereby preventing contaminants from draining back into the fuel injectors.

7. The fuel rail of claim 1, wherein said fuel return channel is inclined relative to the fuel injectors, thereby permitting drainage of contaminants from the fuel rail.

8. The fuel rail of claim 1, wherein said fuel supply channel is in fluid communication with said fuel return channel, said fuel rail further comprising fuel bypass means for regulating the amount of fuel flowing from said supply channel to said return channel, said fuel bypass means bypassing fuel at its maximum rate when the engine is at idle, thereby resulting in maximum cooling of fuel in said supply channel by fuel in said return channel when it is most needed.

9. The fuel rail of claim 2, wherein said means for providing fluid communication include passages extending from said fuel supply channel to each of the fuel injectors.

* * * * *

UNITED STATES PATENT AND TRADEMARK OFFICE
CERTIFICATE OF CORRECTION

PATENT NO. : 5,423,303

DATED : June 13, 1995

INVENTOR(S) : David E. Bennett

It is certified that error appears in the above-identified patent and that said Letters Patent is hereby corrected as shown below:

On the title page at Item [76] Inventor, "Country" should read --County--.

Column 1, line 5, insert --co-pending-- after the word "Applicant's".

Column 6, line 26, claim 3, "claim 1" should read --claim 2--.

Column 6, line 35, claim 5, "claim 1" should read --claim 2--.

Column 6, line 45, claim 7, "claim 1" should read --claim 2--.

Column 6, line 48, claim 8, "claim 1" should read --claim 2--.

Signed and Sealed this

Twenty-third Day of April, 1996

Bruce Lehman

*Attest:*

BRUCE LEHMAN

*Attesting Officer*

*Commissioner of Patents and Trademarks*